United States Patent [19]

Saunders

[11] 4,380,477

[45] Apr. 19, 1983

[54] CLEANING PIPES USING MIXTURES OF LIQUID AND ABRASIVE PARTICLES

[75] Inventor: David H. Saunders, Cranfield, England

[73] Assignee: National Research Development Corporation, London, England

[21] Appl. No.: 204,720

[22] Filed: Nov. 6, 1980

[30] Foreign Application Priority Data

Nov. 9, 1979 [GB] United Kingdom ..... 7938982

[51] Int. Cl.[3] ..... B08B 9/02

[52] U.S. Cl. ..... 134/7; 51/321; 51/411; 51/439; 134/8

[58] Field of Search ..... 134/7, 8; 51/319, 320, 51/321, 411, 439

[56] References Cited

U.S. PATENT DOCUMENTS

| | | | |
|---|---|---|---|
| 2,884,745 | 5/1959 | Fritze et al. | 51/411 X |
| 2,951,319 | 9/1960 | Kornhaus | 51/411 |
| 3,427,763 | 2/1969 | Maasberg et al. | 51/411 X |
| 3,858,358 | 1/1975 | Stachowiak et al. | 51/427 |
| 3,972,150 | 8/1976 | Hart | 51/427 X |
| 4,055,025 | 10/1977 | Seese et al. | 51/411 |
| 4,125,969 | 11/1978 | Easton | 51/321 X |

FOREIGN PATENT DOCUMENTS

| | | | |
|---|---|---|---|
| 309510 | 12/1929 | United Kingdom . | |
| 558221 | 12/1943 | United Kingdom . | |
| 730756 | 5/1955 | United Kingdom . | |
| 810812 | 3/1959 | United Kingdom | 51/411 |
| 1090476 | 11/1967 | United Kingdom . | |

*Primary Examiner*—Marc L. Caroff

*Attorney, Agent, or Firm*—Oblon, Fisher, Spivak, McClelland & Maier

[57] ABSTRACT

Cleaning apparatus and method, particularly for the inner surfaces of pipes. A conical sheet water jet issues from a vortex chamber and a second conical sheet jet issues from a second vortex chamber in which the water and abrasive have swirled at lesser pressure. The two jets impinge to form a resultant conical jet which strikes and cleans the pipe wall. Guides hold the apparatus within the pipe so that the axes of the pipe and all the jets coincide, and the hoses by which water and abrasive reach the apparatus may also be used to help move the apparatus up and down the pipe. The axial sense of the resultant jet may be such that it exerts a "squeegee" action upon the pipe wall when the apparatus is withdrawn from the pipe by pulling the hoses.

13 Claims, 7 Drawing Figures

CLEANING PIPES USING MIXTURES OF LIQUID AND ABRASIVE PARTICLES

This invention relates to the use of jets of liquid containing abrasive particles for cleaning purposes. It relates especially to the cleaning of the internal surfaces of pipes and vessels, in particular the pipes used in drains, sewers and chemical plant.

It is known to clean such pipes by passing down the middle of them a high pressure water hose on the end of which is a nozzle manifold arranged so that it is coaxial with the pipe and discharges a number of discrete jets against the inner wall of the pipe. However experience shows that unless either the nozzle or the pipe can be rotated the entire pipe wall will not be cleaned. Experience also shows that water alone is often unable to clean such pipes adequately and attempts have been made to generate jets containing both water and abrasive particles by entraining the abrasive into a jet of water after it has left the nozzle, a technique which is frequently used for cleaning external surfaces. However, this technique does not overcome the problem of cleaning the entire pipe wall.

According to the present invention, apparatus to create a cleaning spray comprises means to create a high-pressure jet of liquid in substantially conical sheet form, and means to create a jet including abrasive particles and of generated form coaxial with the cone and arranged so that the two jets intersect, the resultant jet still being of substantially conical form and containing both liquid and abrasive particles.

The axial direction of the second jet may be either the same as or opposite to that of the first conical jet, and the second jet may also be in the form of a cone.

The first conical jet may be created by a vortex-generating nozzle, and the second jet may also be created by such a nozzle in which the liquid and the abrasive, which have been pre-mixed to form a slurry, swirl together before they are discharged but in which the pressure of the slurry is far less than in the first nozzle, thus diminishing wear by abrasion.

The invention includes a method of cleaning pipes using such apparatus, in which the axes of the two jets are substantially aligned with that of the pipe, and the apparatus may include a hose by which the nozzles are connected to sources outside the pipe of abrasive and pressurised liquid, usually water.

The apparatus may also include means to centralise it within the pipe and may be arranged so that the resultant cleaning jet of liquid plus abrasive particles is "retro-active", that is to say the axial direction of this jet points towards the end of the pipe at which the nozzles were introduced and from which they will later be withdrawn, so that as they are withdrawn down the pipe the resultant jet tends to sluice towards the open end such dirt as has already been removed.

The apparatus may also include means, for instance conduits delivering air under pressure, which communicate with the space that becomes enclosed by the intersection of the two jets, to prevent a vacuum forming within this space and thus distorting the shape of the first, second or resultant jets.

The invention is further stated by the claims at the end of this specification and will now be described, by way of example, with reference to the accompanying diagrammatic drawings in which:

Figure 1:
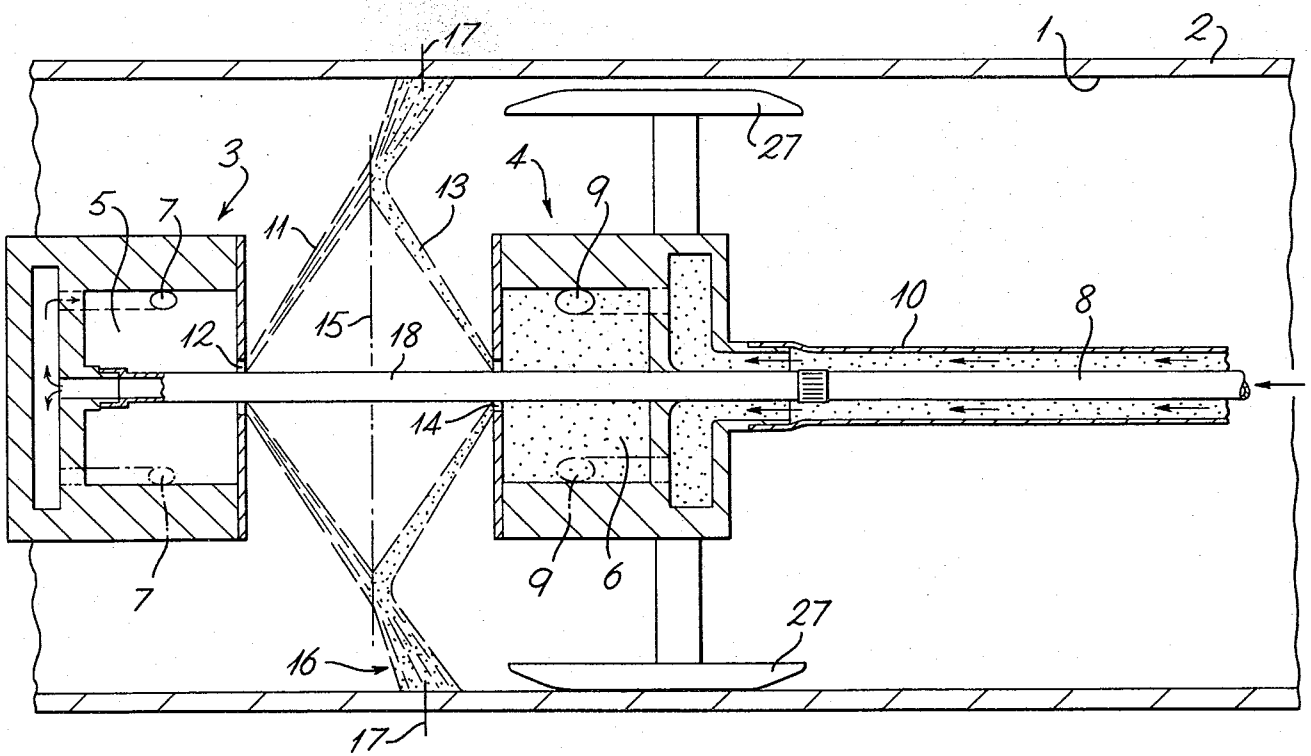
FIG. 1 is a diagrammatic part-section through a pipe being cleaned by apparatus according to the invention.

FIG. 1 shows one apparatus according to the invention in action, cleaning the inner surface 1 of a pipe 2. The apparatus comprises jet units 3, 4 containing chambers 5, 6 respectively, in each of which chambers fluid is formed into a vortex and from which it emerges as a conical jet which is substantially coaxial with pipe 2 because it is held in position by skids 27. Chamber 5 is supplied with water at high pressure (for a sewer pipe of about nine inches internal diameter, typically 3,000 psi) through two tangential inlet ports 7 by way of a high pressure hose 8 and chamber 6 is supplied with an abrasive/water slurry through tangential inlet ports 9 by way of a hose 10. Chamber 5 discharges a high pressure water jet 11, of conical sheet form, from a nozzle 12 and chamber 6 discharges a conical sheet-form jet 13, comprising a mixture of abrasive and water, from a nozzle 14. The two jets intersect at the transverse plane 15 and combine to form a resultant jet 16 which comprises a mixture of abrasive and water, and which because of the greater momentum of jet 11 points in the same general axial direction as that jet but is of wider cone angle and strikes and cleans the inner surface 1 of pipe 2 in the region of transverse plane 17. Jet units 3 and 4 are held and located together by a hollow connecting strut 18, which also serves to connect chamber 5 to hose 8, and hoses 8 and 10 serve not only to supply the ingredients of the jets but also as the means whereby the apparatus may be inserted into the pipe and later withdrawn from it. It should be noted that the general axial direction of resultant jet 16 is opposite to that in which the apparatus will be withdrawn from a pipe by the pulling of the hoses 8 and 10, so that the action of the jet will then be to "squeegee" or sluice the dislodged dirt towards the aperture in the wall of pipe 2 by which the apparatus gained access to the pipe interior.

Figure 2:
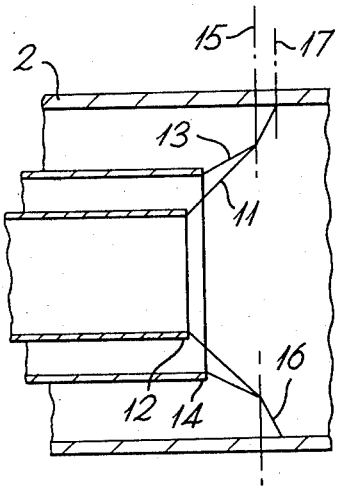
FIGS. 2–5 are diagrammatic sections through alternative constructions for producing the first and second jets.

FIG. 2 shows an alternative construction in which high pressure nozzle 12 lies radially within lower pressure nozzle 14 so that jets 11 and 13 point in the same axial direction, meeting at transverse plane 15 as before to form a resultant jet 16 which again strikes the inner wall 1 of pipe 2 around transverse plane 17. This arrangement has the result, which could be advantageous, that the abrasive particles from jet 13 tend to get entrained into the outer surface of jet 16, which is of course the surface of that jet which strikes the pipe wall first.

Figure 3:
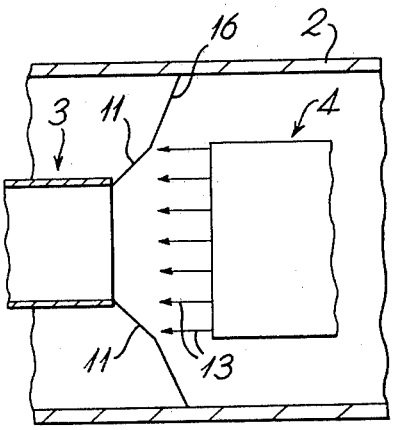
Figure 6:
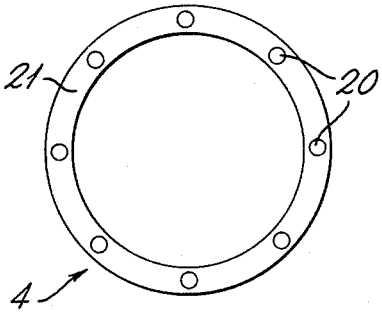
FIG. 6 is an end view of the abrasive nozzle of FIG. 3.

FIG. 3 shows another alternative construction in which the axial directions of jets 11 and 13 are opposite to each other. In this version of the apparatus, however, while jet 11 is still a high pressure conical sheet of water, jet 13 comprises dry abrasive. This is shot, as FIG. 6 shows, from holes 20 equally spaced around an annular end face 21 of unit 4 which in this version takes the form simply of a container for sand with suitable means (not shown) to expel that sand dry through the holes 20.

Figure 4:
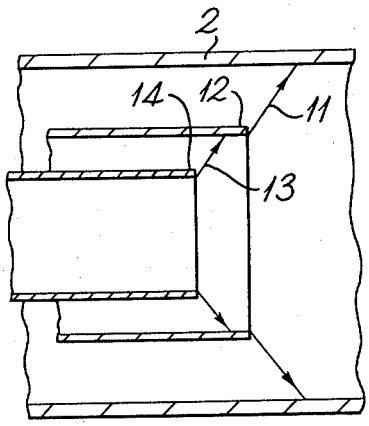

FIG. 4 shows a version of the invention in which the nozzle 14 of the abrasive/water jet lies radially within the nozzle 12, and with its mouth axially recessed within the mouth of nozzle 12, so that there is full mixing of the abrasive with the water before it forms high velocity jet 11, thus tending to accelerate the abrasive to the speed of jet 11. It should be noted that while in this version of the invention the abrasive does make contact with nozzle 12, which must therefore be made of very hard material to resist the resulting wear and can also be a replaceable item, it still does not make contact with the high pressure vortex chamber 5 of unit 3 where it would undoubtedly create serious wear no matter what material was used.

Figure 5:
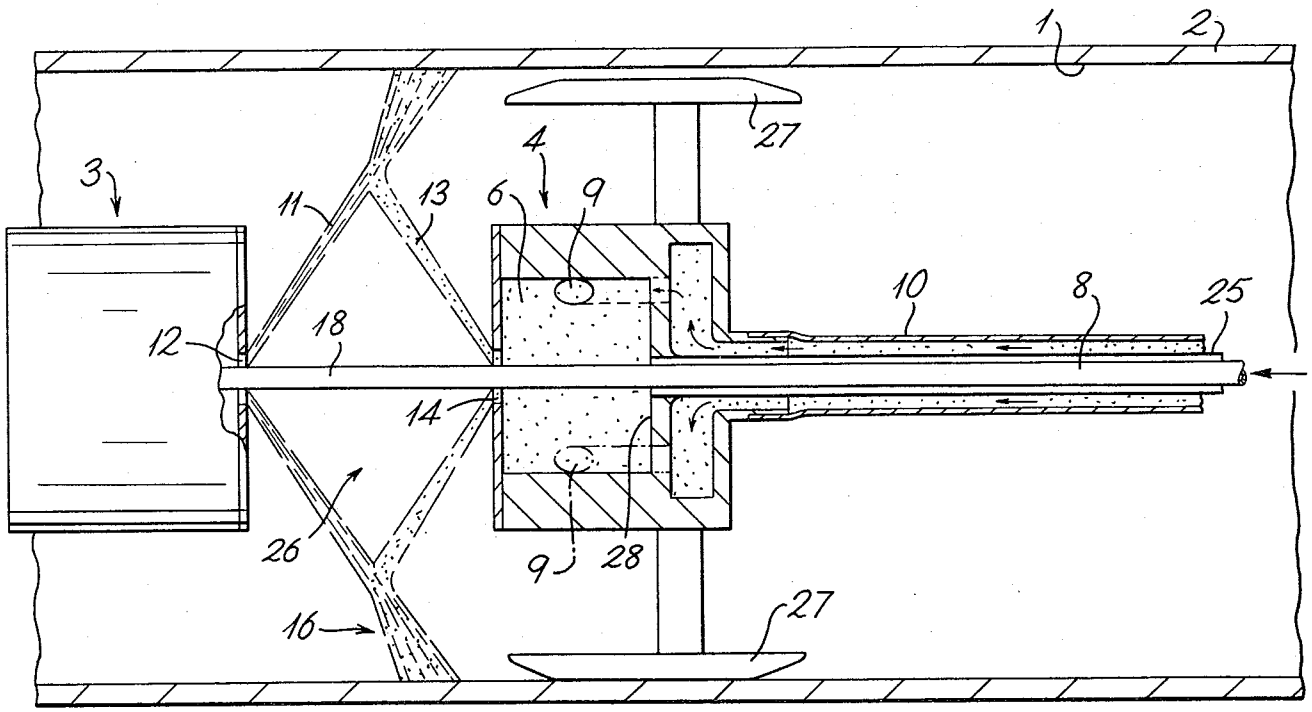

FIG. 5 shows a modification to the apparatus of FIG. 1 in which a conduit 25, coaxial with hoses 8 and 10 and discharging into chamber 6, delivers air to the space 26 that becomes enclosed by the intersecting conical jets 11 and 13. Because this space extends as a central core into both of chambers 5 and 6, conduit 25 can as shown terminate at the end wall 28 of chamber 6. The motion of the liquid of the jets tends to evacuate space 26, which in turn tends to cause the jets to be drawn inwardly. By preventing the vacuum, the air from conduit 25 helps to maximise the cone angle of resultant jet 16 and thus the normality with which that jet strikes and cleans the inner wall 1 of pipe 2.

Figure 7:
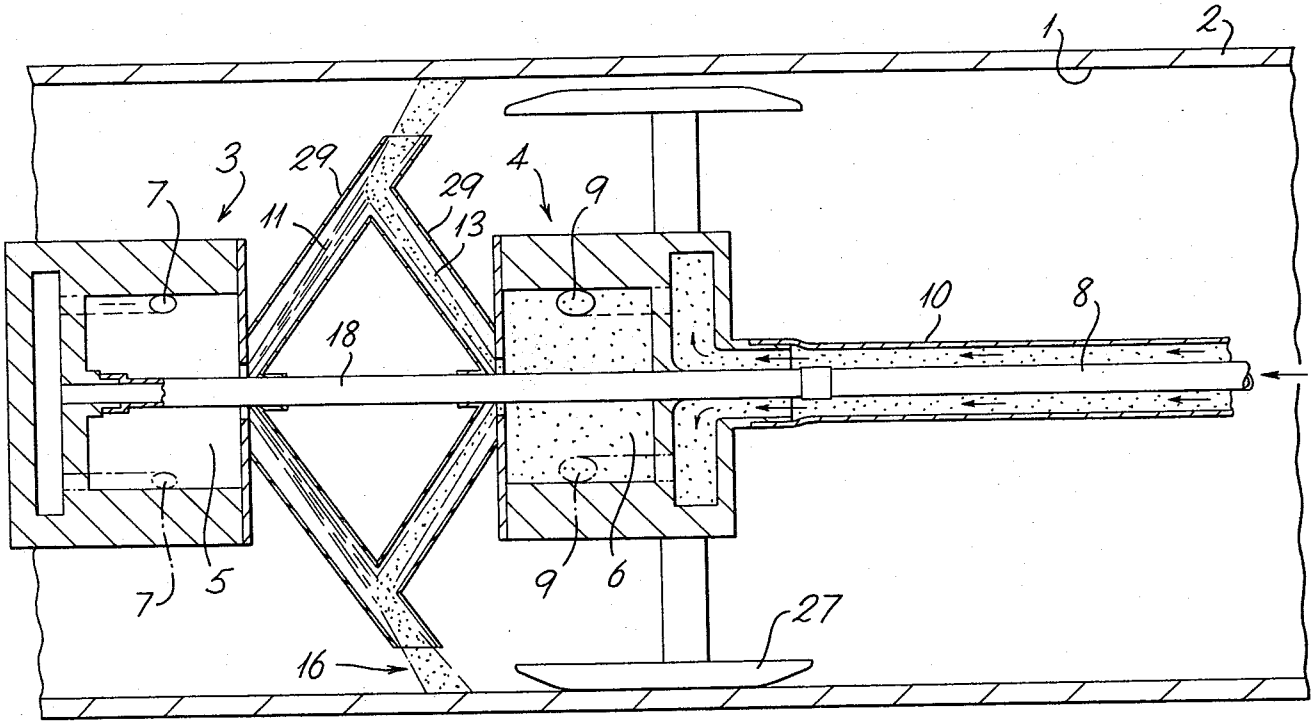
FIG. 7 shows a modification to the apparatus of FIG. 1.

FIG. 7 shows a modification to the apparatus as shown in FIG. 1 in which flow-directing plates 29 are fitted. The intermingling of the jets 11 and 13 at plane 15 could have the effect of spreading the cleaning band on the inner pipe wall; plates 29 help to stop this spreading and so give a more concentrated cleaning band.

I claim:

1. Apparatus to create a cleaning spray comprising:

first jet means comprising a chamber formed about a first axis and including tangential inlet means for directing high-pressure liquid into tangential contact with an interior surface of said chamber, said surface being of a configuration to cause said liquid to swirl within said chamber, and an axially-facing outlet nozzle through which said liquid is discharged from said chamber as a first jet of liquid in sheet form and in the form of a hollow cone;

second jet means connected to a source of abrasive particles and for discharging a second jet of said particles, said second jet being hollow and conforming to the surface of a solid generated about a second axis coaxial with said first axis;

said first and second jet means being arranged so that said first and second jets intersect to form a resultant hollow jet, and so that said resultant jet is of substantially hollow conical form and contains both liquid and abrasive particles.

2. Apparatus according to claim 1 in which the axial direction of said first and second jets is the same.

3. Apparatus according to claim 1 in which the axial direction of said first and said second jets are opposite to each other.

4. Apparatus according to claim 1 in which said second jet is of conical form.

5. Apparatus according to claim 1 comprising a second vortex-generating nozzle to create said second jet, and in which said second jet is created by causing a slurry of pre-mixed said liquid and said abrasive to swirl within said second vortex-generating nozzle before discharge.

6. Apparatus according to claim 1 including support means whereby to support said apparatus centrally within a cylindrical pipe being cleaned.

7. Apparatus according to claim 6 including handling means whereby said apparatus can be introduced in an axial direction to the interior of said pipe, and later withdrawn from it in the opposite axial direction, and in which said handling means are so attached to said apparatus that the axial direction of said resultant jet is towards the end of said pipe from which said apparatus will be withdrawn.

8. Apparatus according to claim 7 in which said handling means comprises hoses adapted to connect said first and second jet means with the sources of said liquid and abrasive.

9. Apparatus according to claim 1 in which said first and second jet means are so arranged that the said intersection of said first and said second jets creates a space enclosed by said jets, and including means communicating with said space, said communicating means being adapted to supply gas to said space whereby to prevent a vacuum forming within said space and thus distorting the shape of any of said first, second and resultant, jets.

10. A method of cleaning pipes comprising:

using a first vortex-generating nozzle to produce a high-pressure first jet of liquid in substantially conical sheet form, the axis of said cone being substantially coincident with that of said pipe;

said nozzle comprising a chamber formed about a first axis and including tangential inlet means for directing high-pressure liquid into tangential contact with an interior surface of said chamber, said surface being of a configuration to cause said liquid to swirl within said chamber, and an axially-facing outlet nozzle through which said liquid is discharged from said chamber as a first jet of liquid in sheet form and in the form of a hollow cone;

generating a second jet containing abrasive particles, said second jet being of generated form coaxial with said first jet;

causing said first and second jets to intersect to form a resultant jet, containing both liquid and abrasive particles and of substantially conical form, also coaxial with said pipe;

causing said resultant jet both to strike the inner wall of said pipe around its entire periphery and to move axially within said pipe, whereby to clean said inner wall of said pipe.

11. A method of cleaning pipes according to claim 10, in which said second jet is created by a second vortex-generating nozzle, and in which the creation of said second jet includes swirling a slurry of said liquid and said abrasive in said second vortex-generating nozzle at a pressure less than that of said liquid in said first vortex-generating nozzle.

12. A method of cleaning pipes according to claim 11 in which an axial direction of said second jet is opposite to that of said first jet.

13. A method of cleaning pipes according to claim 11 in which an axial direction of said second jet is the same as that of said first jet.

* * * * *